US005303762A

United States Patent [19]

Chandley

[11] Patent Number: 5,303,762

[45] Date of Patent: * Apr. 19, 1994

[54] COUNTERGRAVITY CASTING APPARATUS AND METHOD

[75] Inventor: George D. Chandley, Amherst, N.H.

[73] Assignee: Hitchiner Manufacturing Co., Inc., Milford, N.H.

[ * ] Notice: The portion of the term of this patent subsequent to Sep. 15, 2009 has been disclaimed.

[21] Appl. No.: 916,014

[22] Filed: Jul. 17, 1992

[51] Int. Cl.[5] ..... B22D 18/06

[52] U.S. Cl. ..... 164/63; 164/255

[58] Field of Search ..... 164/63, 255, 134, 133, 164/119, 306

[56] References Cited

U.S. PATENT DOCUMENTS

| | | | |
|---|---|---|---|
| 1,606,236 | 11/1926 | Kadow . | |
| 3,774,668 | 11/1973 | Iten, et al. . | |
| 4,112,997 | 9/1978 | Chandley . | |
| 4,733,714 | 3/1988 | Smith . | |
| 4,957,153 | 9/1990 | Chandley . | |
| 4,961,455 | 10/1990 | Redemske et al. . | |
| 4,982,777 | 1/1991 | Chandley . | |
| 5,069,271 | 12/1991 | Chandley et al. . | |
| 5,146,973 | 9/1992 | Chandley | 164/63 |

*Primary Examiner*—Kuang Y. Lin

*Attorney, Agent, or Firm*—Flynn, Thiel, Boutell & Tanis

[57] ABSTRACT

A method for the countergravity casting of a melt involves placing a refractory mold in a vacuum chamber defined within a casting box where the mold may be optionally surrounded by support particulates in the vacuum chamber. The mold includes a mold cavity and a serpentine melt inlet passage formed by nested refractory members below the mold cavity and in melt flow communication therewith. The serpentine melt inlet passage is communicated with a fill tube extending from the casting chamber toward an underlying source of melt. The mold/chamber and the source are relatively moved to engage the fill tube and the source. A differential pressure is applied between the mold cavity and the source to urge the melt upwardly through the fill tube and serpentine melt inlet passage into the mold cavity. The mold/chamber and the source are then relatively moved to disengage the fill tube and the source after the mold cavity is filled with the melt. The mold/chamber as a unit is rotated in a direction that the serpentine melt inlet passage prevents runout of melt from the mold cavity until the mold/chamber are inverted.

15 Claims, 4 Drawing Sheets

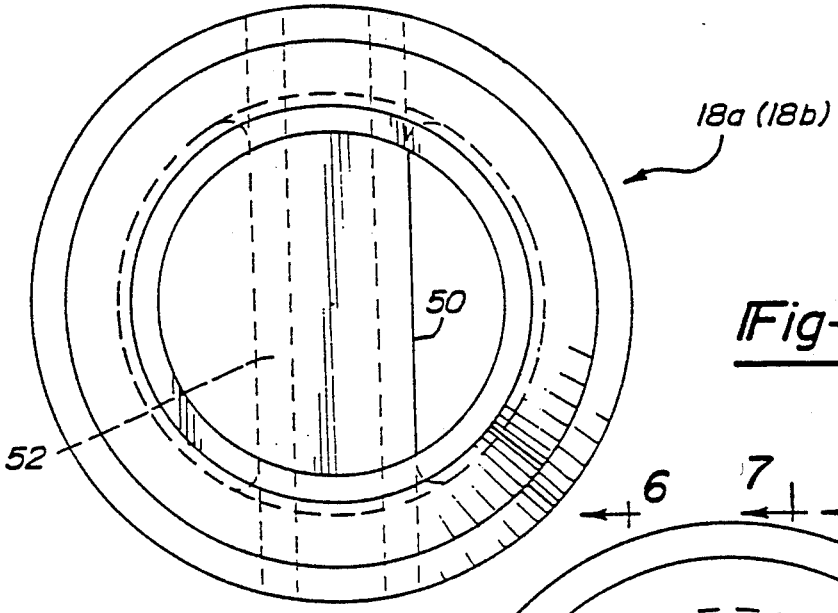
Fig-4
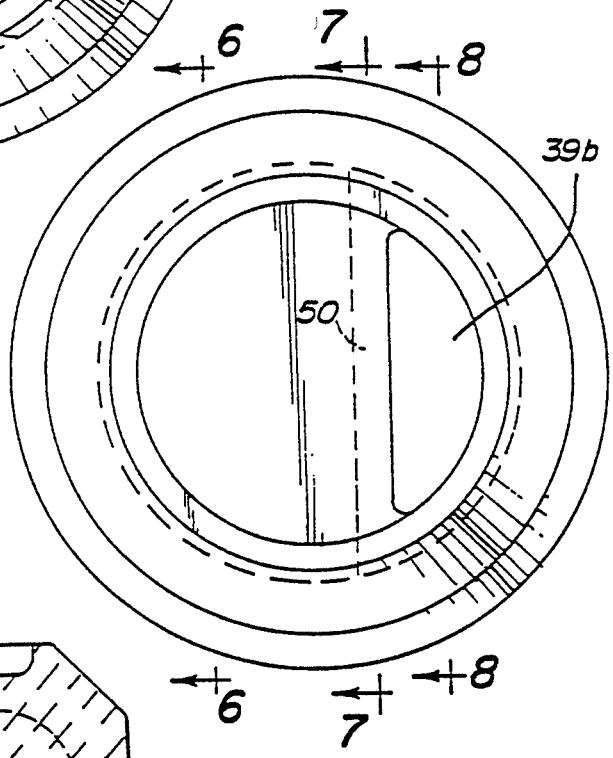
Fig-5
Fig-7
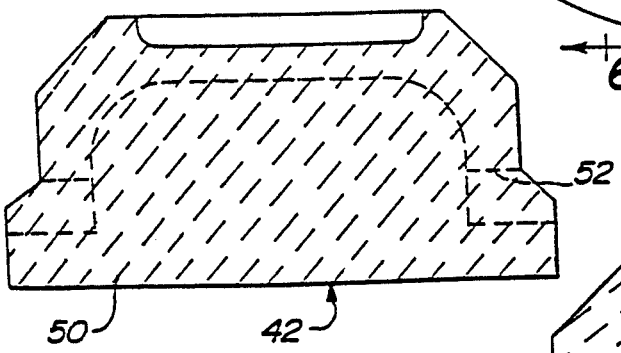
Fig-8
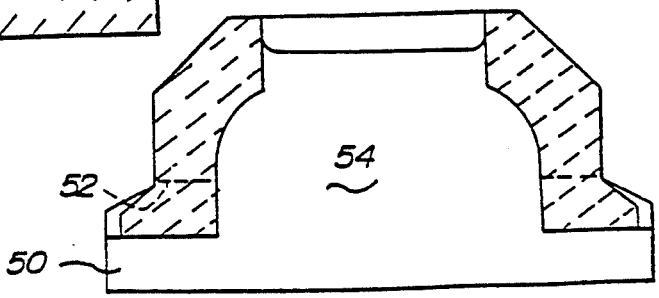

COUNTERGRAVITY CASTING APPARATUS AND METHOD

FIELD OF THE INVENTION

The present invention relates to a method and apparatus for the differential pressure, countergravity casting of a melt into a mold in shortened cycle times.

BACKGROUND OF THE INVENTION

The Chandley U.S. Pat. No. 4,982,777 issued Jan. 8, 1991, and copending Chandley application Ser. No. 628,479, now U.S. Pat. No. 5,146,973, of common assignee herewith describe methods for the differential pressure, countergravity casting of molten metal from a molten metal pool into a self-supporting, gas permeable mold disposed in a casting chamber or box wherein the mold is engaged with (e.g., immersed in) the pool, a differential pressure is established to urge the melt upwardly into the mold, the filled mold is withdrawn from the pool before the metal solidifies therein, and the filled mold is inverted to permit the molten metal to solidify in the inverted mold. A relative vacuum is maintained in the casting chamber to draw the molten metal upwardly into the mold from the pool and as the filled mold is withdrawn from the pool to prevent molten metal runout therefrom. Once the mold is inverted, the vacuum is discontinued.

These methods are advantageous in that shortened casting cycle times are achievable as a result of the reduction in the time that the mold must be immersed in the molten metal pool and the time that the differential pressure must be maintained in the casting chamber.

The Chandley U.S. Pat. No. 5,069,271 issued Dec. 3, 1991 employs a thin-walled, gas permeable mold which is supported by a particulates support media (e.g., dry foundry sand) in a casting chamber or box, the support media being compacted about the mold when the differential pressure is established in the casting chamber for countergravity casting.

An object of the present invention is to provide an improved method and apparatus for differential pressure, countergravity casting of a melt in shortened cycle times into a mold via a serpentine melt inlet passage communicated to a mold cavity thereabove for allowing withdrawal of the melt-filled mold from the melt source before the melt solidifies therein and inversion of the melt-filled mold without melt runout from the mold cavity.

Another object of the present invention is to provide an improved method and apparatus for differential pressure, countergravity casting of a melt in shortened cycle times into a mold via a serpentine melt inlet passage formed between a pair of identical refractory components, one of which is inverted and mated to the other to form the serpentine inlet passage therebetween.

SUMMARY OF THE INVENTION

The present invention contemplates a method for the countergravity casting of a melt, as well as apparatus for practicing the method, wherein a refractory mold is placed in a vacuum chamber defined within a casting box. The mold may be optionally surrounded by support particulates in the vacuum chamber. The mold includes a mold cavity in melt flow communication with a serpentine melt inlet passage disposed below the mold cavity in the vacuum chamber. The serpentine melt inlet passage is communicated with a fill tube extending from the casting chamber toward an underlying source of melt. The mold/chamber and the source are relatively moved to engage the fill tube and the source. A differential pressure is applied between the mold cavity and the source to urge the melt upwardly through the fill tube and serpentine melt inlet passage into the mold cavity. While maintaining said differential pressure, the mold/chamber and the source are then relatively moved to disengage the fill tube and the source after the mold cavity is filled with the melt. The mold/chamber are rotated in a direction that the serpentine melt inlet passage prevents runout of melt from the mold cavity until the mold/chamber are inverted. The serpentine melt inlet passage forms an "S" shaped passage when the mold is rotated to orient the fill tube in a horizontal position.

In one embodiment of the invention, first and second identical refractory members are mated together in the vacuum chamber to define the melt inlet passage, one of said first and second refractory members being inverted and mated to the other to define the serpentine melt inlet passage. Each of the first and second refractory members includes a lateral, chordal wall and lateral, chordal groove spaced therefrom on a respective mating side thereof that are mated together such that the chordal wall of the first member is received in the chordal groove of the second refractory member and the chordal groove of the first refractory member receives the chordal wall of the second refractory member when the sides are nested.

The aforementioned objects and advantages of the present invention will become more readily apparent from the following detailed description and drawings.

DESCRIPTION OF THE DRAWINGS

FIG. 4 is a plan view of one side of the assembly of refractory members in the direction of arrows 4—4, FIG. 3.

FIG. 5 is a plan view of a side of one refractory member.

FIG. 7 is a cross-sectional view along lines 7—7 of FIG. 5.

FIG. 8 is a cross-sectional view along lines 8—8 of FIG. 5.

DETAILED DESCRIPTION OF THE INVENTION

Figure 1:
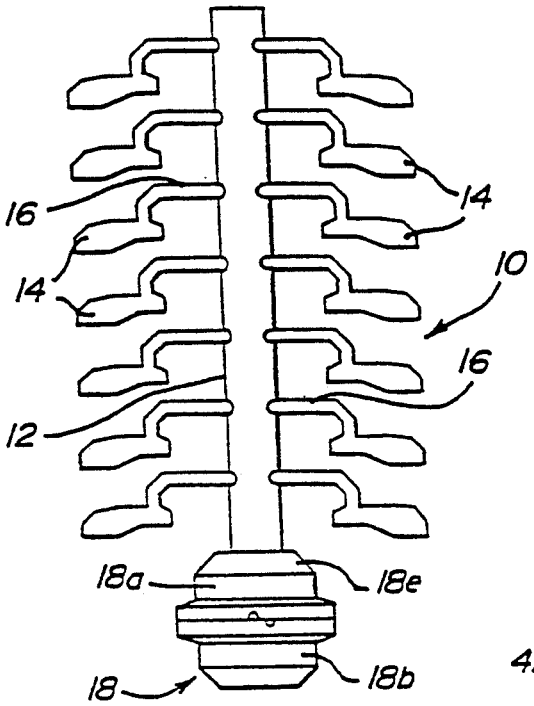
FIG. 1 is a side elevation of a pattern assembly.

Referring to the drawings, there is shown in FIG. 1 an expendable pattern assembly or tree 10 comprising a central, cylindrical riser-forming portion 12 and a plurality of mold cavity-forming portions 14 each connected to the riser-forming portion 12 by a respective ingate-forming portion 16. The mold cavity-forming portions 14 are configured in the shape of the article or part to be cast and are spaced apart about the periphery of the riser-forming portion 12 and along the length thereof as shown. Typically, each mold cavity-forming portion 14 and its respective ingate-forming portion 16 are injection molded and then manually attached (e.g., wax welded or adhered) onto the riser-forming portion 12. The riser-forming portion 12 is typically formed by injection molding as a separate piece.

A refractory collar 18 comprising first and second refractory members 18*a*, 18*b* is attached (e.g., wax welded or adhered) to the lower end of the riser-forming portion 12. As will become apparent herebelow, the refractory members 18*a*, 18*b* preferably are identical in configuration or construction and are nested together to define a serpentine melt inlet passage 39 therebetween, FIG. 3, in the mold invested about the pattern assembly 10. The first and second refractory members are fastened together at mating sides 42 by adhesive or ceramic bonding before attachment of the collar 18 to the lower end of the riser-forming portion 12.

The pattern assembly 10 is typically made of a meltable material, wax being the preferred material for the pattern assembly due to its low cost and predictable properties. In general, the pattern wax melts in the range of about 130° F. to about 150° F. Importantly, wax viscosity is selected to avoid shell cracking during the pattern removal operation (e.g., wax viscosity at 170° F. should be less than 1300 centipoise). Other materials, such as urea and styrofoam, which are removable by heating, dissolution, etc., may also be useful as a pattern material, however.

It is not necessary in practicing the invention that the various portions 12, 14, 16 of the pattern assembly 10 be made of the same pattern material so long as the pattern assembly 10 is subsequently removable by heating, dissolution, etc. Pattern removal by steam autoclaving is described herebelow, although the invention is not so limited.

Figure 2:
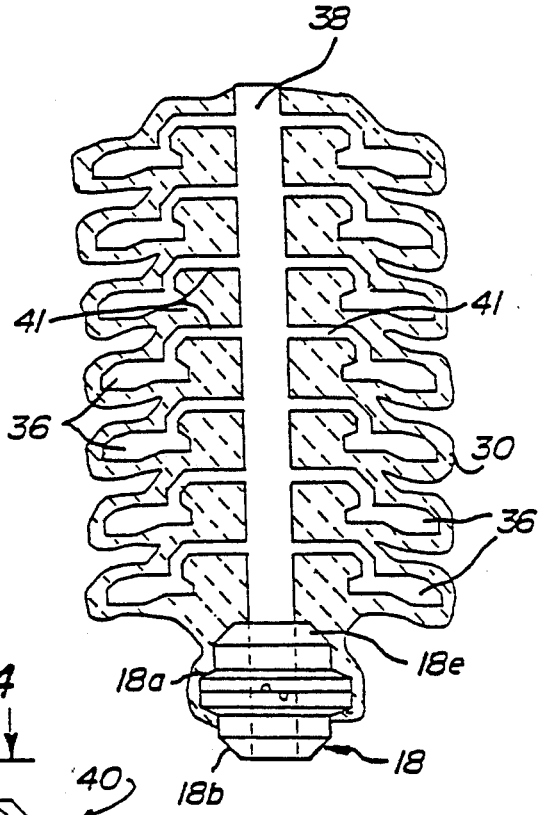
FIG. 2 is a sectioned, side elevation of the pattern assembly after investing with refractory particulate mold material and removal of the pattern.

Referring to FIG. 2, the pattern assembly 10 is invested with multiple layers of refractory material to form a shell mold 30 thereabout. The pattern assembly 10 is invested by repeatedly dipping it in a refractory slurry (not shown) comprising a suspension of a refractory powder (e.g., zircon, alumina, fused silica, and others) in a binder solution, such as ethyl silicate or colloidal silica sol, and small amounts of an organic film former, a wetting agent, and a defoaming agent. After each dipping, excess slurry is allowed to drain off and the slurry coating on the pattern assembly is stuccoed or sanded with dry, coarse refractory particles. Suitable refractory materials for stuccoing include granular zircon, fused silica, various aluminum silicate groups including mullite, fused alumina, and similar materials.

After each sequence of dipping and stuccoing, the slurry coating is dried or hardened using forced air drying or other means to form the refractory layer on the pattern assembly 10 or on the previously formed refractory layer. This sequence of dipping, stuccoing, and drying is repeated until a multi-layered shell mold 30 of desired wall thickness is formed about the pattern assembly.

The shell mold 30 may be formed to various thicknesses in the range of about 0.12 to about 0.50 inch. In one embodiment of the invention, the shell mold is formed to have a maximum wall thickness not exceeding about 0.12 inch in accordance with the Chandley U.S. Pat. No. 5,069,271, the teachings of which are incorporated herein by reference. In general, a shell wall thickness not exceeding about 0.12 inch is built up or comprised of four to five refractory layers formed by the repetitive dipping, stuccoing, and drying sequence described above. Such a thin-walled shell mold 30 is advantageous in its ability to accommodate stresses imposed thereon during the pattern removal by steam autoclaving as described, for example, in that patent. The invention can be practiced, however, with conventional thicker-walled shell molds.

The shell mold 30 is typically formed about the pattern assembly 10 including the refractory members 18*a*, 18*b* so as to incorporate or attach the collar 18 integrally with the formed mold. In particular, the shell mold 30 is formed about the joint between the members 18*a*, 18*b*.

For purposes of illustration and not limitation, the shell mold 30 is formed on a pattern assembly 10 like that shown in FIG. 1 wherein the portions comprise pattern wax. The pattern assembly 10 is dipped in an initial slurry comprising 200 mesh fused silica (15.2 weight %), and 325 mesh zircon (56.9 weight %), colloidal silica binder (17.8 weight %), and water (10.1 weight %). Excess slurry is drained and the slurry stuccoed while wet with 100 mesh zircon. The pattern assembly was subsequently dipped in a second slurry comprising Mulgrain M-47 mullite (15.1 weight %), 200 mesh fused silica (25.2 weight %), and 600 mesh zircon (35.3 weight %), ethyl silicate binder (15.6 weight %), isopropanol (8.8 weight %) and stuccoed after draining each slurry dip in sequence by 60 mesh Mulgrain mullite, and the balance being stuccoed by about 25 mesh Mulgrain M-47 mullite. The shell mold was formed by about 4–5 slurry dips/stuccoes in the manner described.

Figure 9:
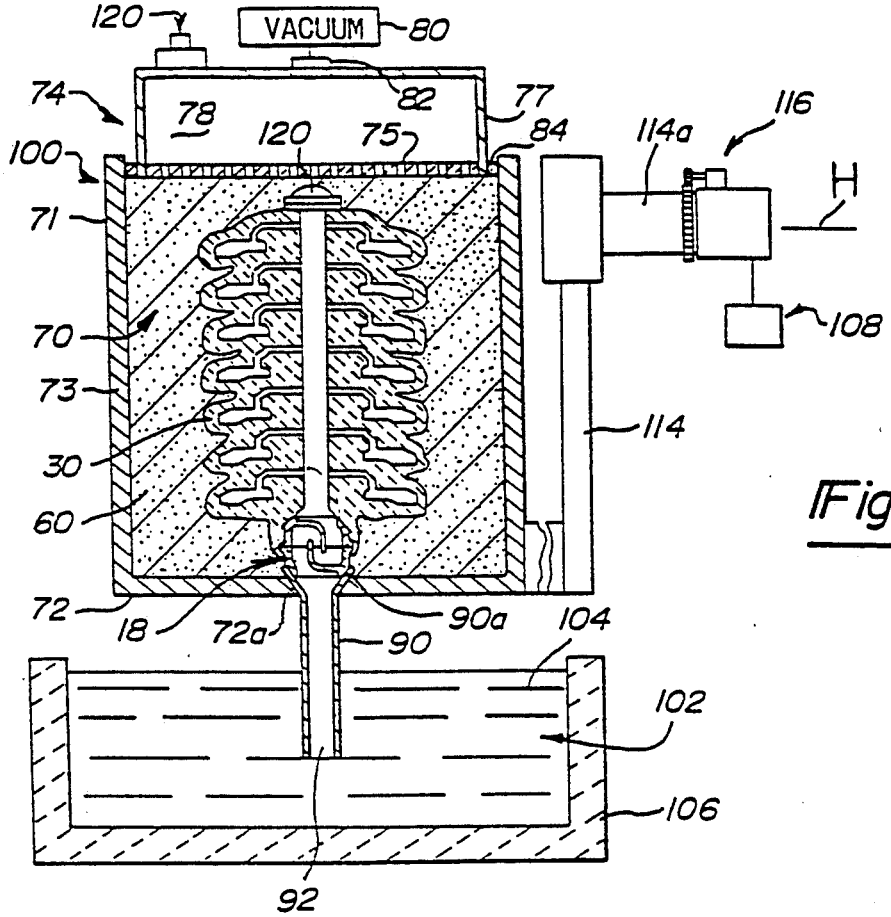
FIG. 9 is a schematic sectioned elevational view of a countergravity casting apparatus in accordance with one embodiment of the invention showing the mold disposed in a particulates support medium in a vacuum chamber of a casting box with a fill tube immersed in an underlying pool (source) of melt.

Alternately, a conventional investment shell mold 30 can be formed about the pattern assembly 10 sans the collar 18 (i.e., the mold does not include a lower end formed about collar 18). The collar 18 then can be fastened to the shell mold by applying ceramic patch or adhesive (not shown) on collar surface 18*e* and inserting the collar 18 in the open bottom end of the shell mold, which is formed with a bottom surface having a complementary shape to collar surface 18*e* for bonding thereto via the ceramic patching. Alternately, the collar 18 can be held against the bottom end surface of the shell mold by the support media 60 (e.g., foundry sand) disposed in the evaluated casting box 71 as shown in FIG. 9 without the use of any ceramic patch of adhesive therebetween.

Figure 3:
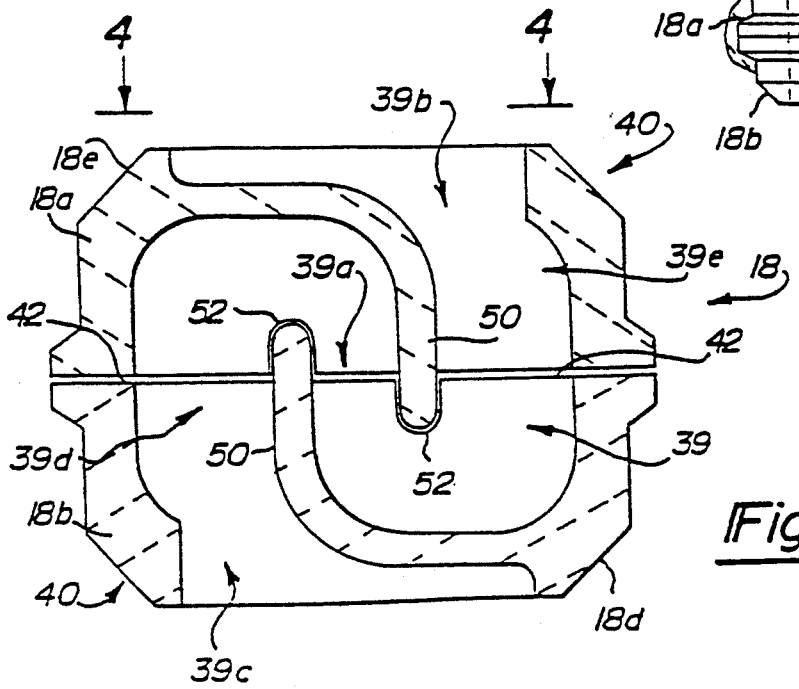
FIG. 3 is an enlarged side sectioned view of the first (upper) and second (lower) refractory members forming the serpentine melt inlet passage.

The refractory members 18*a*, 18*b* preferably are identical in configuration and are fastened together with the upper member 18*a* inverted and mated against the lower member 18*b* as shown best in FIG. 3 to form the serpentine melt inlet passage 39.

Referring to FIGS. 5–8, a single refractory member 18*a* or 18*b* is shown in detail. Only one of the members 18*a*, 18*b* is shown since in this embodiment of the invention they are identical in configuration and construction. Each refractory member 18*a* or 18*b* comprises a bowl-shaped refractory body 40, such as pressed fireclay ceramic, having a circular profile. Each body 40 includes a first side 42 and a second side 44. The first side 42 of each body 40 is configured to mate and nest with that of the other body 40 so as to define the serpentine melt inlet passage 39 therebetween. In particular, the first side 42 of each body 40 includes a lateral, chordal wall 50 and lateral, chordal groove 52 spaced therefrom across the bowl-shaped recessed region 54 such that, when the upper member 18*a* is inverted and its side 42 is mated and nested with side 42 of the lower member 18*b*, the chordal wall 50 of the upper (first) member 18*a* is received in the chordal groove 52 of the lower (second) refractory member 18*b* and the chordal groove 52 of the upper (first) refractory member 18*a* receives the chordal wall 50 of the lower (second) refractory member 18*b*, FIG. 3. The lateral, chordal walls 50 overlap or oppose one another in the vertical direction to define a central region 39*a* of the melt inlet passage 39 as a result of being received in the respective groove 52 of the mating refractory member. As is apparent, a horizontally oriented "S" shaped melt inlet passage 39 is formed between the refractory members 18*a*, 18*b* when the mold 30 is in the upstanding (vertical) orientation shown in FIGS. 9–10.

The melt inlet passage 39 includes an upper open end 39*b* communicating to the central riser portion 12 and a lower open end 39*c* for communicating to a fill tube or pipe 90 engaged to a lower frusto-conical surface 18*d* of the lower refractory member 18*b*.

Use of the identical refractory members 18*a*, 18*b* to form the serpentine melt inlet passage 39 is preferred and advantageous in that only one refractory member configuration needs to be made and in that the melt inlet passage 39 can be formed by a simple inversion of one of the refractory members (e.g., the upper member 18*a*) and nesting of its the side 42 with the side 42 of the lower refractory member 18*b*.

FIG. 2 illustrates the refractory shell mold 30 including the collar 18 after removal of the pattern material by steam autoclaving. In particular, for removal of the pattern from the thin walled shell mold described hereabove (i.e., mold wall thickness not exceeding 0.12 inch) the refractory shell mold 30 is positioned inside a steam autoclave (not shown) of conventional construction (e.g., model 286PT available from Leeds and Bradford Co.) and subjected to steam at a temperature of about 275° to about 350° F. (steam pressure of about 80 psi to about 110 psi) for a time sufficient to melt the pattern material out of the refractory shell mold formed about the pattern assembly 10. Removal of the pattern material leaves the thin refractory shell mold 30 having mold cavities 36 interconnected to the central riser 38 via the respective ingates 41. The lower end of the riser 38 is communicated to a serpentine melt inlet passage 39 formed in the collar 18; i.e., between the first and second refractory members 18*a*, 18*b*. At this stage of processing, the riser 38 is open at the upper end thereof.

Prior to casting, the shell mold 30/collar 18 are fired at about 1800° F. for 2 hours. If the shell mold 30 is formed without the collar 18, the shell mold and collar are fired separately and assembled with the fill pipe 90 as shown in FIG. 9.

In accordance with one embodiment of the invention, molten metal is differential pressure, countergravity cast into the fired shell mold 30 as illustrated in FIG. 9. In particular, the fired shell mold 30 is supported in a loose, refractory support media 60 itself contained in a vacuum chamber 70 of a casting box or housing 71. The casting box 71 includes a bottom support wall 72, an upstanding side wall 73, and a moveable top end wall 74 defining therewithin a vacuum chamber 78. The bottom wall 72 and the side wall 73 are made of gas impermeable material, such as metal, while the moveable top end wall 74 comprises a gas permeable (porous) plate 75 having a vacuum plenum 77 connected thereto to define a vacuum chamber 78 above (outside) the gas permeable plate 75. The vacuum chamber 78 is connected to a source of vacuum 80, such as a vacuum pump, by a conduit 82. The moveable top end wall 74 includes a peripheral seal 84 that sealingly engages the interior of the upstanding side wall 73 to allow movement of the top end wall 74 relative to the side 73 while maintaining a vacuum seal therebetween.

In assembly of the components shown in FIG. 9 to form casting apparatus 100, a ceramic fill tube or pipe 90 is sealingly received via a gasket (not shown) in bottom opening 72*a* of the bottom wall 72 for providing a lower melt inlet passage 92 extending from the bottom wall 72 toward an underlying source 102 of molten metal. The lower frusto-conical surface 18*d* of the lower collar member 18*b* is sealingly engaged by ceramic adhesive to a similar-shaped flange 90*a* of the fill tube 90. A refractory cap 120 is placed atop the shell mold 30 to close off the upper end of the riser 38. The loose refractory particulate support medium 60 (e.g., loose foundry silica sand of about 60 mesh) is introduced into the vacuum chamber 70 (end wall 74 removed) about the mold 30 while the casting box 71 is vibrated to aid in settling the of the support media 60 in the chamber 70 about the mold. The moveable top end wall 74 is then positioned in the open upper end of the casting box with the peripheral seal 84 sealingly engaging the side wall 73 and with the inner side of the gas permeable plate 75 facing and in contact with the support media 60.

After assembly, the casting apparatus 100 is positioned above a source 102 (e.g., a pool) of the molten metal to be cast. Typically, the molten metal is contained in a casting vessel 106. The casting apparatus 100 is lowered by an actuator 108, such as a hydraulic, pneumatic, electrical or other actuator, that is operably connected by an actuator arm 114 to the casting box 71. The casting apparatus is lowered toward the pool 102 to a casting position where the lower open end of the fill tube 90 is immersed in the pool. After the fill tube is immersed, a vacuum is drawn in the vacuum chamber 78 of the vacuum plenum 77 and hence in the vacuum chamber 70 through the plate 75 by actuation of the vacuum pump 80. Evacuation of the chamber 70, in turn, evacuates the mold cavities 36 through the thin gas permeable shell mold wall. The level of vacuum in chamber 70 is selected to be sufficient to draw the molten metal 104 upwardly from the pool 102 through the fill tube 90, the serpentine melt inlet passage 39, and the riser 38 into the mold cavities 36 when the fill tube 90 is immersed in the pool 102 as shown in FIG. 9.

When the vacuum is drawn in vacuum chambers 70, 78, the top end wall 74 is subjected to atmospheric pressure on the side thereof external of the seal 84 while the inner side of the plate 75 is subjected to a relative vacuum. This pressure differential across the top end wall 74 causes it to compress or rigidize the support media 60 about the mold 30 to support it against casting stresses.

The molten metal 104 is drawn through the fill tube 90, the serpentine passage 39 and the riser 38 into the mold cavities 36 via the ingates 41. The molten metal is thereby differential pressure, countergravity cast into the mold cavities 36.

After the mold cavities 36 are filled with the molten metal, the arm 114 is raised by the actuator 108 to raise the casting apparatus 100 a sufficient distance away from the pool 102 to withdraw (disengage) the fill tube 90 from the pool 102. During raising of the casting apparatus 100, the vacuum is maintained in the chambers 70, 78 by the vacuum pump 80.

Figure 10:
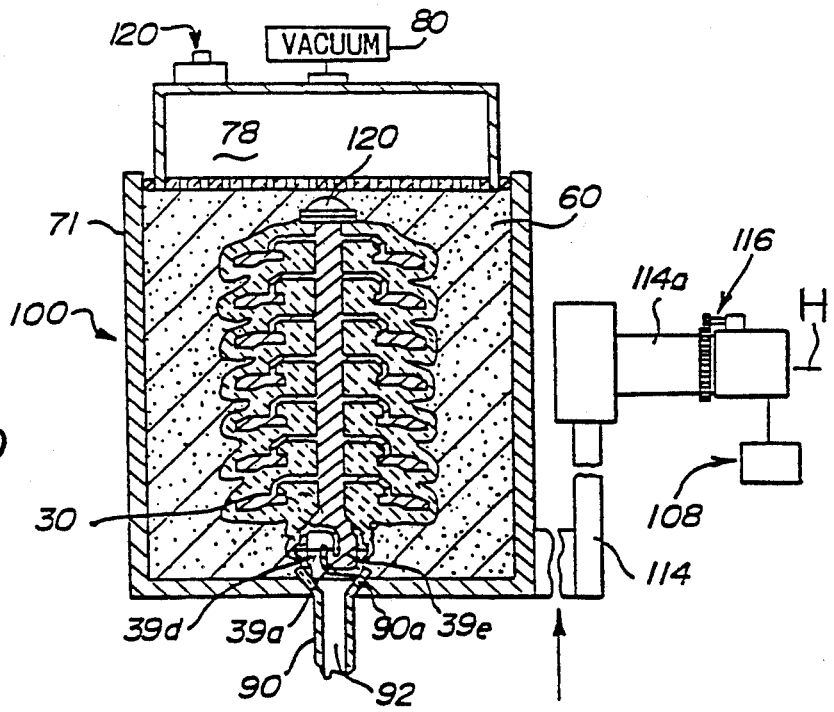
FIG. 10 is similar to FIG. 9 but after the mold is filled with the melt and the mold is disengaged from the pool.

Upon withdrawal of the fill tube 90 from the pool 102, the molten metal in the fill tube drains out by gravity-induced run-out as shown in FIG. 10. However, the molten metal in the serpentine melt inlet passage 39 only drains out of a downstream region 39*d* thereof communicating directly with lower open end as shown. The molten metal in the central region 39*a* of the serpentine passage 39 (defined between the upstanding lateral, chordal walls 50) and the region 39*e* upstream thereof toward the riser 38 is held against runout by the chordal walls 50 as is apparent in FIG. 10. The molten metal that drains from the fill tube 90 and the serpentine passage 39 returns to the pool 102 for recasting into another mold.

The withdrawn casting apparatus 100 is then rotated using a rotary actuator 108 of conventional type operably connected by a gear train 116 to an extension 114*a* of the support arm 114. The casting apparatus 100 is rotated about horizontal axis H from the upstanding position of FIG. 10 to the inverted position shown in FIG. 11 where the fill tube 90 is disposed above the mold 30.

The casting apparatus 100 is rotated in the direction of the arrow in FIG. 10; i.e., in a clockwise direction in FIG. 10. This direction of rotation allows the lateral chordal walls 50 to prevent runout of the still molten metal in the serpentine passage 39 and mold 30 during the tilting operation. In effect, the chordal walls 50 act as a dam for confining the molten metal against runout without the need for a valve in the passage 39; i.e., a valveless melt inlet passage 39 is provided to prevent melt runout during mold rotation. When the casting apparatus 100 is tilted 90° clockwise (i.e., to a horizontal position), the serpentine passage 39 will be oriented to form an "S" shaped passage. Once the casting apparatus 100 is inverted, FIG. 11, there is no problem of metal runout from the mold as will be apparent.

Figure 11:
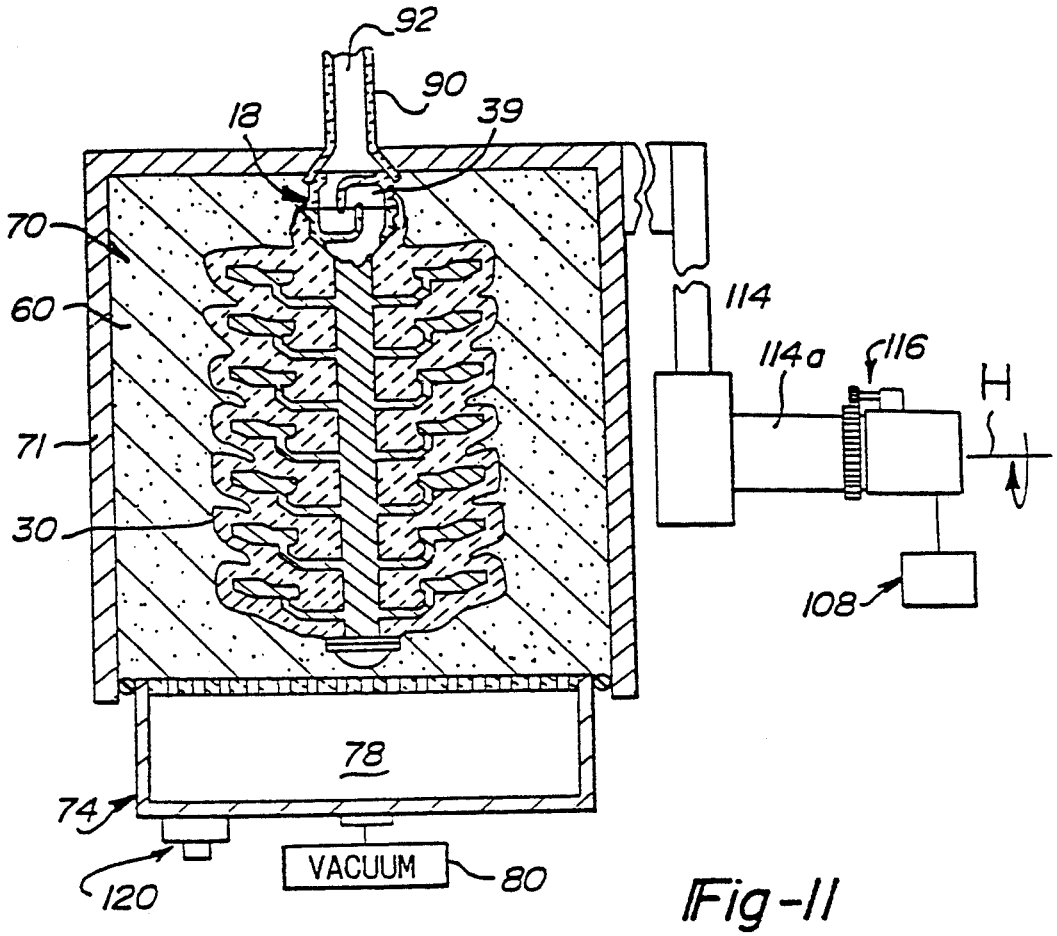
FIG. 11 is similar to FIGS. 9-10 but after the mold has been inverted to allow the melt to solidify therein in the inverted position with the vacuum released.
Figure 6:
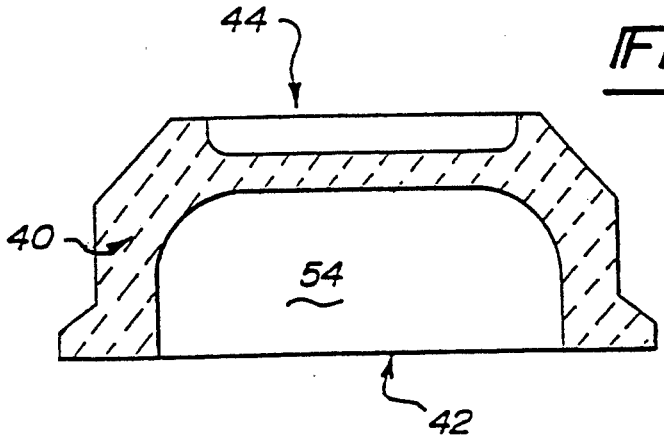
FIG. 6 is a cross-sectional view along lines 6—6 of FIG. 5.

The arm 114, arm extension 114*a* and gear train 116 are shown out of position in FIGS. 9–11 for convenience. Those skilled in the art will appreciate that their actual position is normal to the position shown so as to permit mold tilting in the direction shown in FIG. 10.

After the casting apparatus 100 is inverted, the vacuum in the chambers 70, 78 is released (by a suitable valve 120 for providing ambient pressure in the chambers 70, 78) so as to allow the molten metal in the mold 30 to solidify under ambient (atmospheric) pressure in the inverted mold.

The present invention is especially useful in countergravity casting high shrinkage metals and alloys (e.g., steels, stainless steels, and Ni, Co and Fe based alloys and superalloys). The term high shrinkage refers to the volumetric contraction of the molten metal when it is cooled from the casting temperature to ambient temperature during the solidification step of the process. Certain steels exhibit a high volumetric shrinkage such as about 10% upon cooling from the casting temperature to ambient temperature whereas, in contrast, grey and nodular cast irons exhibit relatively low volumetric shrinkage such as less than about 1%. High shrinkage metals and alloys can be countergravity cast in accordance with this invention without harmful runout of the melt from the mold during the mold tilting operation. Low shrinkage metals and alloys can also be countergravity cast in this manner. However, the invention is especially useful in casting high shrinkage metals and alloys which are more prone to runout of the mold during the mold tilting operation.

For example, a mold 30 of the type described and shown in the drawings was vacuum countergravity cast with 58 pounds of 4130 steel alloy at a melt casting temperature of 3050° F. A vacuum of 18 inches of mercury was established in vacuum chamber 70 while the fill tube 90 was immersed in the melt pool 102 to draw the melt up into 24 mold cavities, each receiving about 0.8 pounds of melt. The mold was filled in 8 seconds, and the fill tube 90 withdrawn from the melt by raising the casting apparatus. Upon withdrawal, the melt drained from the fill tube 90 and the region 39*d* of the serpentine passage 39 as shown in FIG. 10 back to the melt pool. As soon as melt drainage stopped (about 2 seconds) from the fill tube, the casting apparatus was inverted by rotation about a horizontal axis. No melt was observed to drain from the casting apparatus during the tilting operation.

Although the present invention is described above with respect to a ceramic investment shell mold 30 having the collar 18 thereon, the invention is not limited for use with such ceramic shell molds and instead can be practiced using the well-known bonded sand mold illustrated in U.S. Pat. No. 4,791,977 wherein the collar 18 is fastened thereon to achieve the objects and advantages of the invention. The disclosure of U.S. Pat. No. 4,791,977 is incorporated herein by reference to this end. As used in the claims, the term "mold" includes ceramic shell molds, bonded sand molds as well as other molds.

While the invention has been described in terms of specific embodiments thereof, it is not intended to be limited thereto but rather only to the extent set forth hereafter in the following claims.

I claim:

1. In a method for the countergravity casting of a melt, the steps of:

a) placing a mold in a vacuum chamber defined within a casting box, said mold having a mold cavity in melt flow communication with a melt inlet passage disposed below the mold cavity in the vacuum chamber and having a first ascending passage section for communication with a fill tube, a descending passage section upstream of the first ascending passage section, and a second ascending passage section upstream of the descending passage section in communication with the mold cavity, b) communicating said mold cavity through said melt inlet passage with a fill tube extending toward an underlying source of melt, c) relatively moving the casting box having the mold therein and the source of melt to engage the fill tube and the source, d) applying a differential pressure between the mold cavity and the source of melt to urge the melt upwardly through the fill tube and the melt inlet passage into the mold cavity, e) relatively moving the casting box having the mold therein and the source of melt to disengage the fill tube and the source after the mold cavity is filled with the melt, and f) rotating the casting box having the mold therein in a direction that the melt inlet passage prevents runout of melt from the mold cavity until the casting box and mold therein are inverted.

2. The method of claim 1 wherein first and second identical refractory members are nested together to define the melt inlet passage, one of said first and second refractory members being inverted and mated to the other to define the serpentine melt inlet passage.

3. The method of claim 2 wherein each of the first and second refractory members includes a respective lateral wall and lateral groove spaced therefrom on a respective side thereof that are mated together, the lateral wall of the first refractory member being received in the lateral groove of the second refractory member and the lateral groove of the first refractory member receiving the lateral wall of the second refractory member when the sides are mated.

4. The method of claim 1 including surrounding the mold with particulates in the chamber.

5. The method of claim 1 wherein the serpentine melt inlet passage forms an "S" shaped passage when the mold is tilted to orient the fill tube in a horizontal position.

6. In a method for the countergravity casting of a melt, comprising the steps of:

a) placing a mold in a vacuum chamber defined within a casting box, said mold having a mold cavity and first and second refractory members nested together to define a melt inlet passage below the mold cavity in the vacuum chamber and having a first ascending passage section for communication with a fill tube, a descending passage section upstream of the first ascending passage section, and a second ascending passage section upstream of the descending passage section in melt flow communication with mold cavity, b) communicating the melt inlet passage with a fill tube extending toward an underlying source of melt, c) relatively moving the casting box having the mold therein and the source of melt to engage the fill tube and the source, d) applying a differential pressure between the mold cavity and the source of melt to urge the melt upwardly through the fill tube and melt inlet passage into the mold cavity, e) relatively moving the casting box having the mold therein and the source of melt to disengage the fill tube and the source after the mold cavity is filled with the melt, and f) rotating the casting box having the mold therein in a direction that the melt inlet passage prevents runout of melt from the mold cavity until the casting box and the mold therein are inverted.

7. The method of claim 6 wherein said first and second refractory members are identical and one of said first and second refractory members is inverted and mated to the other to define the melt inlet passage.

8. The method of claim 7 wherein each of the first and second refractory members includes a respective lateral wall and lateral groove spaced therefrom on a respective side thereof adapted to be mated together, the lateral wall of the first member being received in the lateral groove of the second refractory member and the lateral groove of the first refractory member receiving the lateral wall of the second refractory member when the sides are mated.

9. The method of claim 6 including surrounding the mold with particulates in the chamber.

10. Differential pressure, countergravity casting apparatus, comprising:

a) a casting box defining a vacuum chamber therein and having a bottom opening, b) a refractory mold disposed in the vacuum chamber, said mold including a mold cavity, c) means disposed in the vacuum chamber for forming a melt inlet passage below the mold cavity and having a first ascending passage section for communication with a fill tube, a descending passage section upstream of the first ascending passage section, and a second ascending passage section upstream of the descending passage section in melt flow communication with the mold cavity, and d) a fill tube disposed in the bottom opening for communicating the melt inlet passage to an underlying source of melt.

11. The apparatus of claim 10 wherein the melt inlet passage is defined by first and second identical refractory members, one of said first and second refractory members being inverted and mated to the other of the first and second refractory members.

12. The apparatus of claim 10 wherein each of the first and second refractory members includes a lateral wall and lateral groove spaced therefrom on respective side thereof adapted to be mated together, the lateral wall of the first member being received in the lateral groove of the second refractory member and the lateral groove of the first refractory member receiving the lateral wall of the second refractory member when the sides are mated.

13. The apparatus of claim 10 wherein the mold is surrounded by a particulates in the chamber.

14. The apparatus of claim 10 wherein the serpentine melt inlet passage is configured as a horizontally oriented "S" passage when the fill tube is engaged with the source.

15. Differential pressure, countergravity casting apparatus, comprising:

a) a casting box defining a vacuum chamber therein and having a bottom opening, b) a refractory mold disposed in the vacuum chamber, said mold including a mold cavity, c) first and second refractory members mated together to define a melt inlet passage below the mold cavity and having a first ascending passage section for communication with a fill tube, a descending passage section upstream of the first ascending passage section, and a second ascending passage section upstream of the descending passage section in melt flow communication with the mold cavity, and d) a fill tube disposed in the bottom opening for communicating the melt inlet passage to an underlying source of melt.

* * * * *